US008678112B2

(12) United States Patent
Vatne

(10) Patent No.: US 8,678,112 B2
(45) Date of Patent: Mar. 25, 2014

(54) SLIP DEVICE FOR SUSPENDING A DRILL OR CASING STRING IN A DRILL FLOOR

(76) Inventor: Per A. Vatne, Kristiansand (NO)

( * ) Notice: Subject to any disclaimer, the term of this patent is extended or adjusted under 35 U.S.C. 154(b) by 410 days.

(21) Appl. No.: 12/863,243

(22) PCT Filed: Jan. 16, 2009

(86) PCT No.: PCT/NO2009/000020

§ 371 (c)(1),
(2), (4) Date: Dec. 10, 2010

(87) PCT Pub. No.: WO2009/091265

PCT Pub. Date: Jul. 23, 2009

(65) Prior Publication Data

US 2011/0094802 A1 Apr. 28, 2011

(30) Foreign Application Priority Data

Jan. 17, 2008 (NO) ..... 20080307

(51) Int. Cl.
*E21B 19/10* (2006.01)

(52) U.S. Cl.
USPC ..... 175/423; 166/75.14; 166/77.52

(58) Field of Classification Search
USPC ..... 166/75.14, 77.51, 77.52; 175/423
See application file for complete search history.

(56) References Cited

U.S. PATENT DOCUMENTS

| | | | | |
|---|---|---|---|---|
| 1,445,445 | A * | 2/1923 | Livergood | 175/423 |
| 1,501,962 | A * | 7/1924 | Montgomery | 175/423 |
| 1,534,227 | A | 4/1925 | Livergood | |
| 1,541,669 | A | 6/1925 | Summers | |
| 2,134,468 | A | 10/1938 | Bashara | |
| 3,052,943 | A | 9/1962 | Jones | |
| 3,422,506 | A * | 1/1969 | Turner, Jr. | 188/67 |
| 3,538,561 | A | 11/1970 | Anastasiu et al. | |
| 4,072,369 | A * | 2/1978 | Segreto | 175/325.7 |
| 4,332,062 | A * | 6/1982 | Byrne, Jr. | 188/67 |
| 6,089,338 | A * | 7/2000 | Bouligny, Jr. | 175/423 |

FOREIGN PATENT DOCUMENTS

| | | | |
|---|---|---|---|
| DE | 806426 | C | 2/1952 |
| GB | 899752 | A | 6/1962 |
| WO | WO-2007/126319 | A1 | 11/2007 |

OTHER PUBLICATIONS

Ban, Kanja, "International Search Report", for PCT/NO2009/000020 as mailed Apr. 15, 2009, 3 pages.

Larsen, PCT International Preliminary Report on Patentability for PCT/NO2009/000020, Feb. 25, 2010.

Maukonen, Supplementary European search report and written opinion for EP 09702836, Sep. 20, 2012.

* cited by examiner

*Primary Examiner* — David Andrews
*Assistant Examiner* — Richard Alker
(74) *Attorney, Agent, or Firm* — Eubanks PLLC

(57) ABSTRACT

Clamping die (15) in a device for engagement with a cylindrical body (4), which clamping die (15) includes a gripping surface (153) that is arranged to be able to extend in parallel with the center axis of the cylindrical body (4), wherein a groove (154) is provided in each of two side surfaces (151) adjacent to the gripping surface (153) and in close proximity to the gripping surface (153), said groove (154) extending substantially in parallel with the gripping surface (153).

10 Claims, 7 Drawing Sheets

SLIP DEVICE FOR SUSPENDING A DRILL OR CASING STRING IN A DRILL FLOOR

BACKGROUND

The invention relates to a clamping device for temporary suspending a drill or casing string from a drill floor, in which a wedge device forms a substantially circular releasable attachment in an opening in the drill floor and is provided with a series of clamping dies having an engagement surface with variable curvature for engagement with the cylindrical tubular, and a spherical seat for support of the clamping device in the drill floor.

In drilling operations, e.g. exploration and production drilling for oil and gas, clamping devices are used in many situations to engage a cylindrical body, for example a pipe, in particular to suspend a drill pipe within circumscribing structures. One example of this is slips or slips means within a rotary table on a drill floor.

Since tubulars with different pipe diameters are used, a technique is used today where clamping dies, slips and other components that engage with the external pipe surface to retain the tubular in a firm grip, need to be replaced when changes in the external pipe diameter occurs. This is time consuming and costly, and it implies that several sets of clamping devices need to be available at a location that often suffers from lack of space.

When the drilling operations take place from a floating installation, e.g. a floating drill rig or a drill ship, the installation will be moved due to waves and currents in the body of water, and these motions can by a rigid connection between the clamping device and the drill floor result in that the drill string is subjected to bending loads from the clamping device.

The object of the invention is to assist or reduce at least one of the disadvantages of the prior art technology.

The object is achieved by the features that are presented in the description to follow and in the appended claims.

SUMMARY

The invention relates in one aspect to a slips means having one or more clamping dies arranged for engagement with a cylindrical body, in which each clamping die includes a clamping face with a curved form where each lateral portion of the clamping face forms a lip having preferably tapering thickness, wherein within each of the adjacent lateral surfaces are formed a groove provided in parallel with the clamping face and extend inwardly towards a central plane through the clamping die. The grooves are filled with a flexible material, e.g. polyurethane, which provides for that the rigidity of the lips increases. When the clamping face is forced against a cylindrical body having larger radius than the radius of curvature of the clamping face, the lips are forced outwardly such that the engagement surface between the cylindrical body and the clamping face increases. Thus adequate clamping force is achieved without the spot load on the cylindrical body gets unnecessary heavy. The flexibility of the lips is determined by their thickness, the material composition and type of material that is used in the grooves.

In a second aspect the invention relates to a spherical seat arrangement for the wedge device, where the wedge device is a slips means arranged within a rotary table associated with a drill floor.

In a third aspect the invention relates to a slips means which comprises a plurality of auxiliary wedges, each being arranged for slidable support of a clamping die, and where at least one of the auxiliary wedges is provided with an actuator which is arranged for displacement of the auxiliary wedge along an inclined plane.

The invention relates in particular to an arrangement in a clamping die for engagement with a cylindrical body, where the clamping die includes a clamping face that is arranged to be able to extend in parallel with the centre axis of the cylindrical body, wherein a groove is provided in each of two side surfaces adjacent to the clamping face and in close proximity to the clamping face, said groove extending substantially in parallel with the clamping face.

The clamping face is preferably curved having a centre axis in parallel with the centre axis of the cylindrical body.

Each of the grooves and the clamping face forms preferably a lip having substantially gradually tapering thickness from the bottom to the opening of the groove.

The groove is preferably filled with a flexible material different from the material of the surrounding clamping die portions of the groove.

The groove is preferably filled with polyurethane.

The clamping die is preferably arranged in a slips means, a support tong, a power tong or a back-up tong.

The slips means is preferably provided in a spherical seat within a rotary table of a drill floor.

The spherical turning surface centre of the seat is preferably arranged within or in close proximity to the rotary axis of the rotary table.

The slips means preferably comprises a plurality of auxiliary wedges, each being arranged for sliding support of a clamping die.

Preferably at least one of the auxiliary wedges is provided with an actuator which is arranged for displacement of the auxiliary wedge along an inclined plane.

Each of the auxiliary wedges is preferably connected to the adjacent auxiliary wedges by means of one or more carriers for synchronous motion of the auxiliary wedges.

BRIEF DESCRIPTION OF THE DRAWINGS

In the following an example of a preferred embodiment, which is illustrated in the appended drawings, will be described, where.

DETAILED DESCRIPTION

Figure 1:
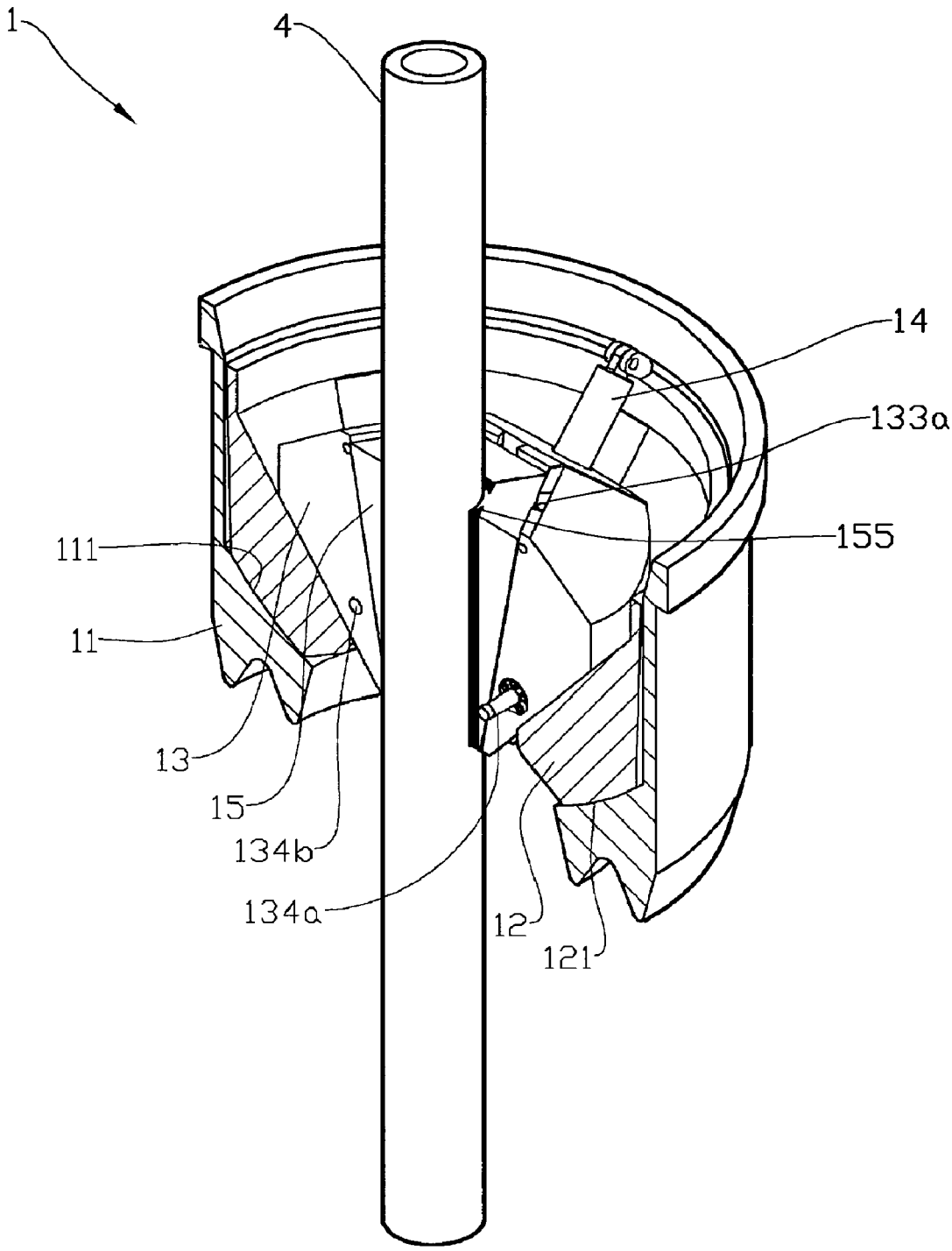
FIG. 1 shows a perspective cross section through a rotary table that comprises a slips means according to the invention.
Figure 2:
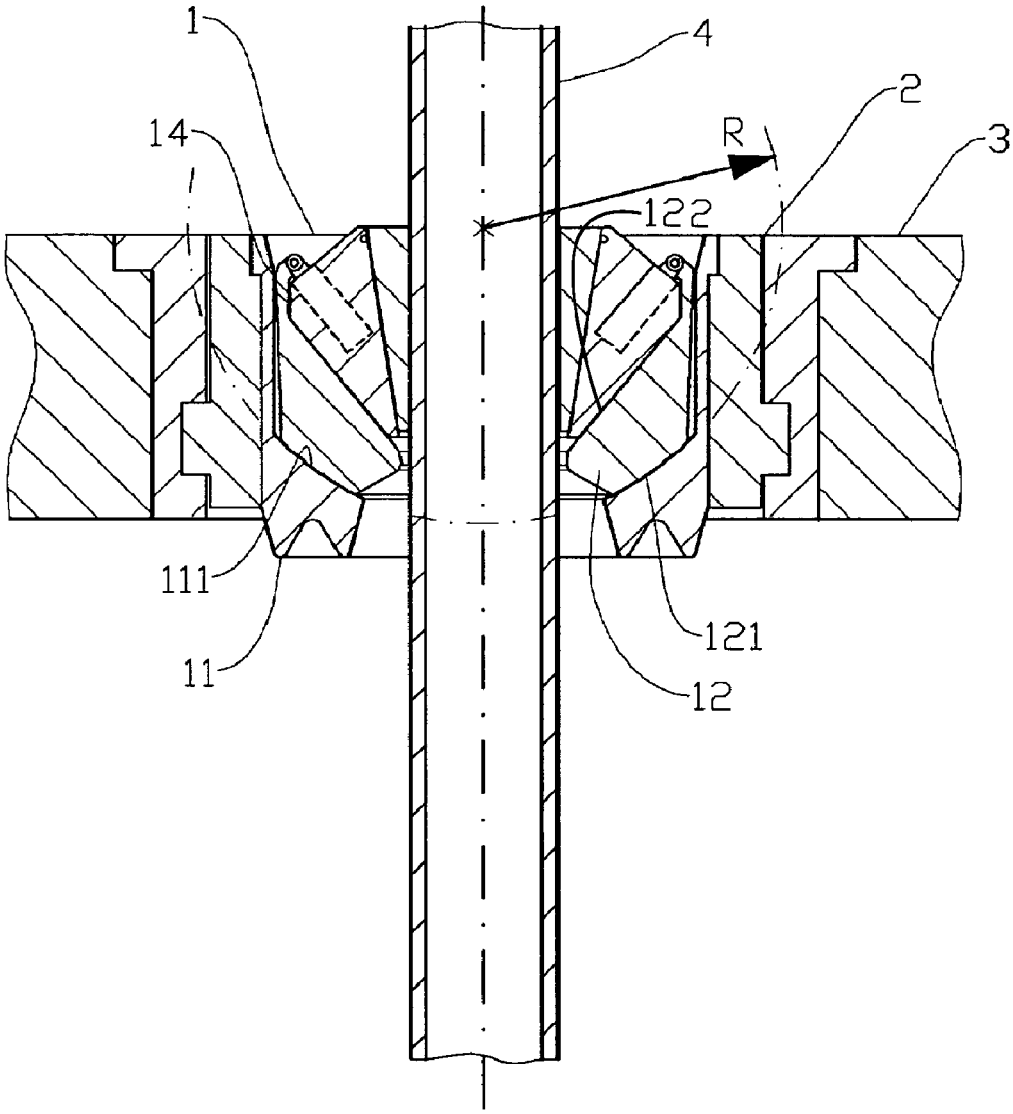
FIG. 2 shows a section through a rotary table having the slips means according to the invention.
Figure 3A:
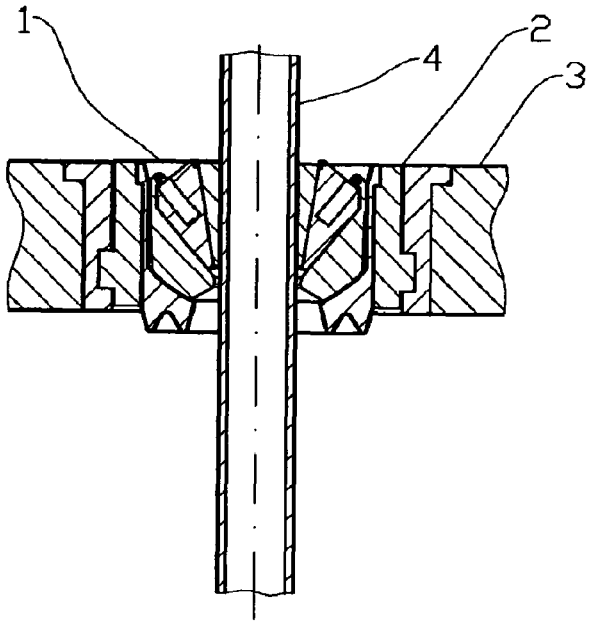
FIG. 3*a* shows in a smaller scale a corresponding section as in FIG. 2, where a centre axis of the pipe string is coincident with the rotary axis of the rotary table.
Figure 3B:
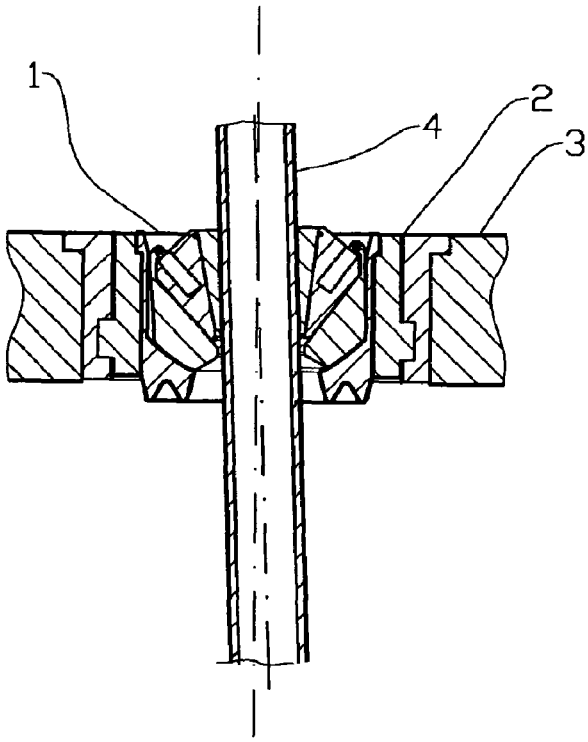
FIGS. 3*b* and 3*c* shows the pipe string suspended inclined in respect of the rotary axis of the rotary table.
Figure 3C:
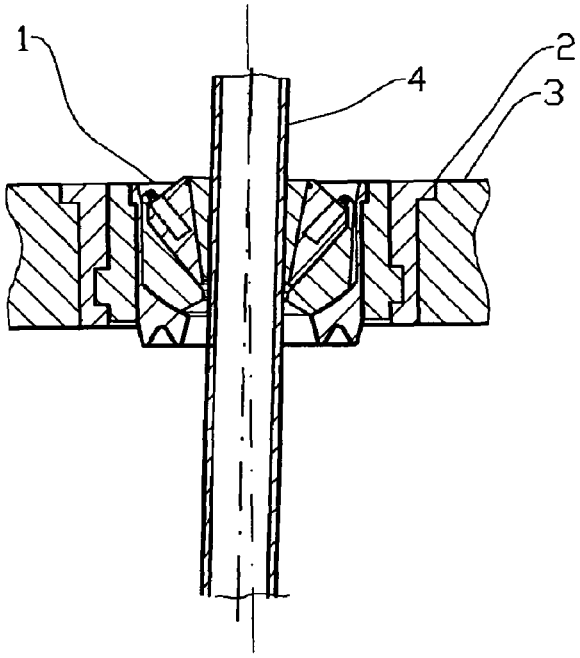
Figure 3D:
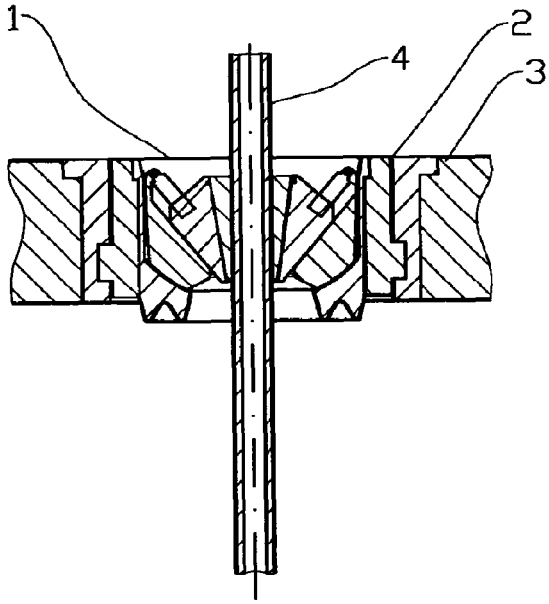
FIG. 3*d* shows the same situation as in FIG. 3*a*, but with the pipe string having smaller diameter.
Figure 4B:
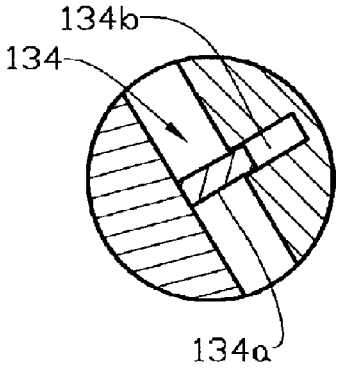
FIG. 4*b* is a detail view of a carrier connecting adjacent wedges in FIG. 4*a;*
Figure 4A:
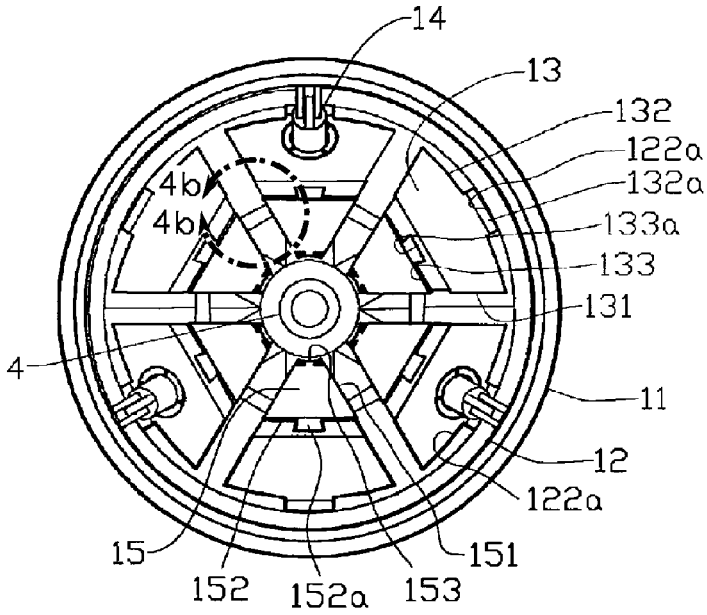
FIG. 4*a* shows in larger scale a top view of the rotary table having a pipe string freely movable in the slips means, the wedges being retracted.
Figure 4D:
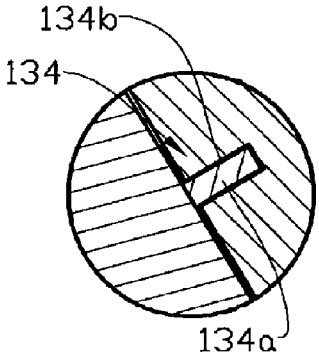
FIG. 4*d* is a detail view of the carrier shown in FIG. 4*c* with the wedges engaged against the pipe wall.
Figure 4C:
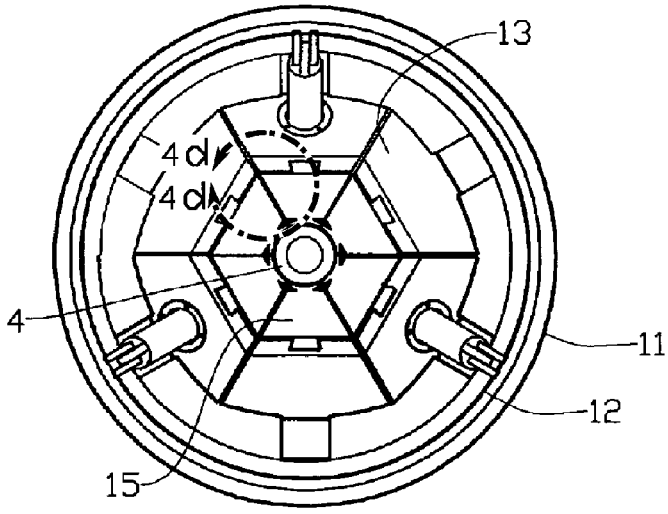
FIG. 4*c* shows a top view of the rotary table having a pipe string suspended in the slips means, said wedges being engaged against the pipe wall.
Figure 5A:
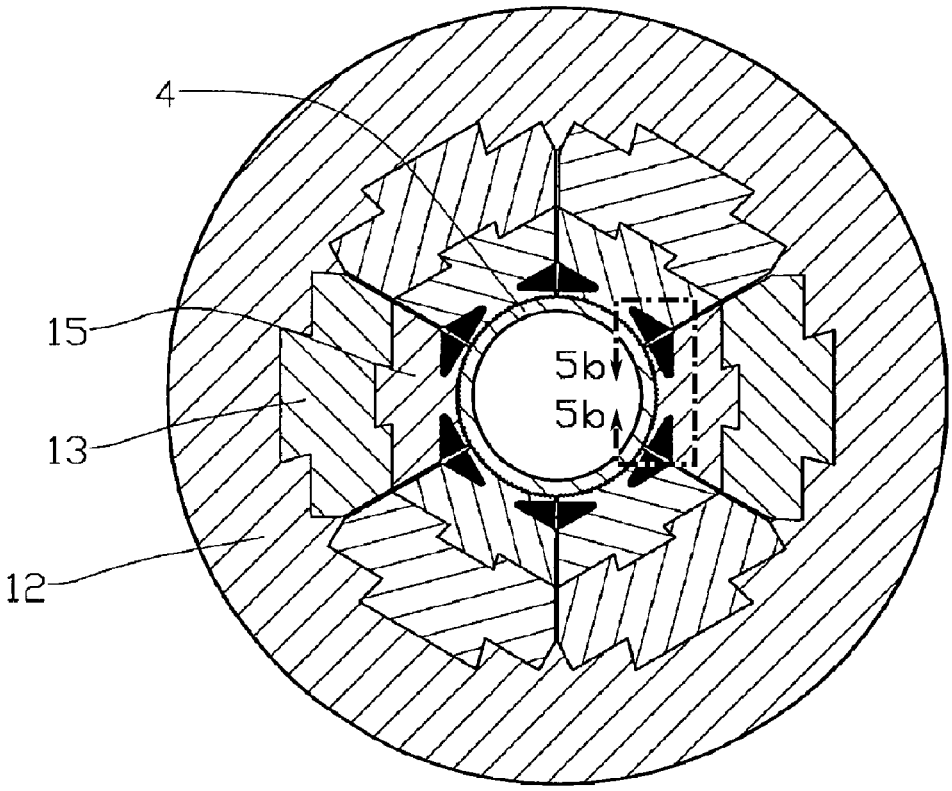
FIG. 5*a* shows in larger scale a cross section through the slips means when it grips around a pipe having small diameter.
Figure 5B:
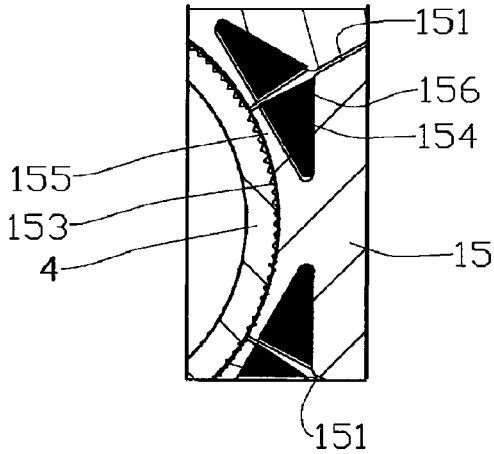
FIG. 5*b* is a detail view of longitudinal grooves in lateral surfaces of wedges depicted in FIG. 5*a;*
Figure 5C:
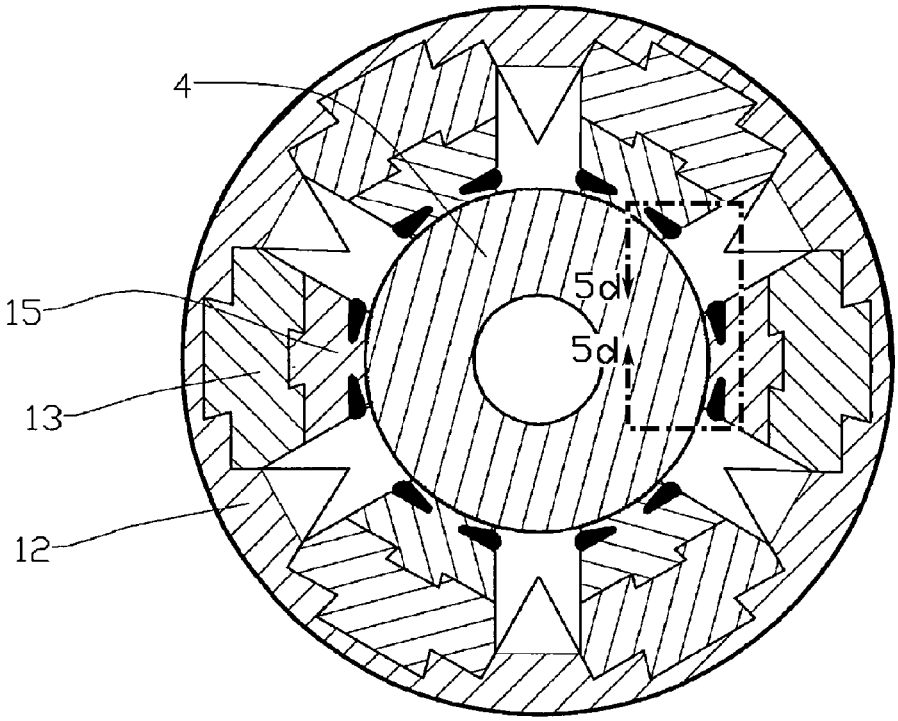
FIG. 5*c* shows what corresponds to FIG. 5*a*, but where a pipe having larger diameter is retained by the slips means.
Figure 5D:
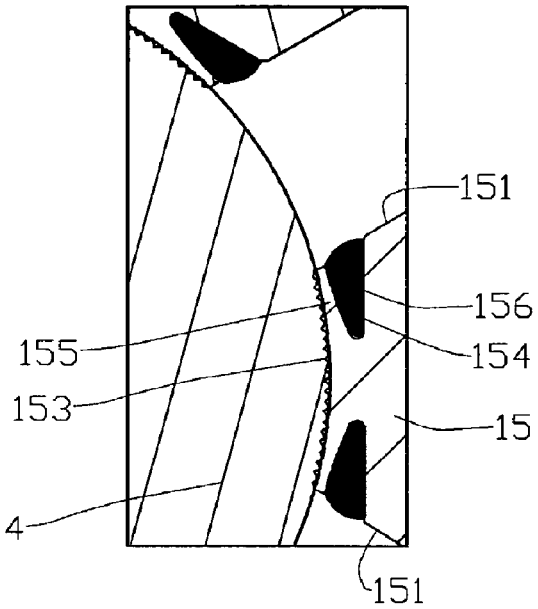
FIG. 5*d* is a detail view of a portion of FIG. 5*c* and generally shows flexing of lips formed by the longitudinal grooves in the lateral surfaces of the wedges when the wedges engage the larger diameter pipe.

A slips means 1 is in a per se known way arranged in a per se known rotary table 2 in a drill floor 3, e.g. on a drill rig that is used during exploration and production drilling for oil and gas. The slips means 1 is arranged to releasably retain a cylindrical body 4, e.g. a drill pipe or a casing.

The slips means 1 is provided with an annular base sleeve 11 that is secured to the rotary table 2. The base sleeve 11 is provided with a spherical seat face 111 having radius R and with its centre located in the centre axis of the rotary table and in close proximity to the upper level of the rotary table 2.

A carrying sleeve 12 is arranged internally of the base sleeve 11, and a spherical support surface 121 is complementary to the seat face 111 of the base sleeve 11. The carrying sleeve 12 has an outer diameter that is slightly smaller than the internal diameter of the base sleeve 11, so that the carrying sleeve 12 thereby can be turned about the centre for the spherical seat face 111 with the consequence that the centre axis of the carrying sleeve 12 is not coincident with the centre axis of the base sleeve 11 and the rotary table 2.

The carrying sleeve 12 is internally provided with totally six inclined first sliding surfaces 122 having centralized first dove tail grooves 122*a*. The sliding surfaces 122 are in the position of use of the slips means 1 inclined from top to bottom in the direction inwardly toward the centre axis of the carrying sleeve and with a centre line that is coincident with the first centre line of the dove tail groove 122*a* and is placed in a plane coincident with said centre axis.

Each sliding surface is arranged for receipt of an auxiliary wedge 13 having lateral surfaces 131 and a first bottom surface 132 and a top surface 133 which converge in the direction downwards and towards the centre axis of the carrying sleeve 12. The lateral surfaces 131 converge towards the top surface 133. The first bottom surface 132 is provided with an elongated first dove tail 132*a* complementary to the first dove tail groove 122*a*.

Every second auxiliary wedge is connected to the base sleeve 11 by means of an actuator 14, here shown as a hydraulic cylinder. Each auxiliary wedge 13 is connected to their adjacent auxiliary wedges 13 by a carrier 134 in the form of a pin 134*a* that projects from a lateral surface 131 of the auxiliary wedge 13 and engages slidable into a complementary recess 134*b* in opposing lateral surface 131 of the adjacent auxiliary wedge 13. Thus a direct displacement of an auxiliary wedge 13 along the sliding surface 122, by operating the actuator 14, results in that the adjacent auxiliary wedges 13 that are not directly connected with an actuator 14, move synchronous with the actuator 14. The operation of all the actuators 14 takes place simultaneously and at the same speed, and thus all the auxiliary wedges 13 move synchronous.

In the top surface 133 of the auxiliary wedge 13 a second dove tail groove 133*a* having a centre line is provided, which is located in a plane coincident with the centre axis of the carrying sleeve 12.

A wedge shaped clamping die 15 is provided with two lateral surfaces 151 and a second bottom surface 152 and an opposing clamping face 153 which together converge in the direction downwardly and towards the centre axis of the carrying sleeve 12. The lateral surfaces 151 converge towards the clamping face 153. The second bottom surface 152 is provided with an elongated second dove tail 152*a* complementary to the second dove tail groove 133*a* in the top surface 133 of the auxiliary wedge 13.

The clamping face 153 of the clamping die 15 is concavely curved having axis direction coincident with the centre axis direction of the carrying sleeve 12. In each of the two lateral surfaces 151 and in close proximity to the clamping face 153, a groove 154 is provided that extends substantially in parallel with the clamping face 153 in the entire longitudinal extension of the clamping die 15. Each of the grooves 154 and the clamping face 153 thus defines a lip 155. The width of the groove 154 is decreasing towards the bottom of the groove.

Each of the grooves 154 is filled with a flexible material 156, typically polyurethane, having elasticity considerably different from the material of the clamping die parts surrounding the grooves 154.

When the slips means 1 is inactive, the auxiliary wedges 13 are retracted, i.e. all the way up into the carrying sleeve 12 and within the central opening of the rotary table 2 a cylindrical body 4, e.g. a drill pipe, can freely be installed or displaced. When the drill pipe 4 is to be retained, the auxiliary wedges 13 are displaced by means of the actuators 14 downwardly and inwardly until the clamping face 153 of the clamping dies 15 engage the drill pipe 4. By the sliding motion of the clamping die 15 against the inclined top surface 133 of the auxiliary wedge 13, a pipe that is suspended in the rotary table 2 will pull the clamping dies downwardly, such that the grip or engagement with the drill pipe 4 is enhanced.

The spherical seat face 111 in the base sleeve 11 and the corresponding support surface 121 that the carrying sleeve 12 abuts the base sleeve 11 with, results in that the centre axis of the slips means and thus the centre axis of the retained cylindrical body 4 can adopt a direction that deviate from the centre axis of the rotary table 2 without adding a bending load to the body 4, for example when a drilling vessel is rolling due to waves.

The lips 155 of the clamping dies that define the clamping face 153 in axial direction form flexible lateral portions in the clamping faces. When the clamping die abuts a cylindrically designed body 4 having larger diameter than the diameter of curvature of the clamping face 153, the lips 155 will yield or give away, and the engaging surface between the clamping die 15 and the cylindrically formed body 4 increases and results in less surface pressure and thus less risk for deformation of the body 4 than if clamping dies according to the prior art that have less diameter of curvature than the diameter of the body 4 is used.

The flexible material 156 provides for that the rigidity of the lips 155 increases. Thus the depth of the grooves 154 can be increased, and the lip 155 can be made larger in order to further improve the properties of the clamping faces 153.

The invention claimed is:

1. A system comprising:

a clamping die for engagement with a cylindrical body, the clamping die including:

a clamping face arranged to be able to extend in parallel with a center axis of the cylindrical body, wherein said clamping face is concavely curved;

two lateral surfaces adjacent to the clamping face and in close proximity to the clamping face, wherein a first lateral surface of the two lateral surfaces includes a first groove provided longitudinally along the first lateral surface and a second lateral surface of the two lateral surfaces includes a second groove provided longitudinally along the second lateral surface;

wherein the first and second grooves are provided longitudinally along the entire length of the two lateral surfaces and extend substantially parallel with the clamping face; and wherein the first and second grooves and said clamping face form flexible clamping die lips between the clamping face and each of the first and second grooves along lateral edges of the clamping face to enable the flexible clamping die lips to yield when the clamping die engages a cylindrical body having a diameter larger than that of the diameter of curvature of the clamping die such that the area of engagement between the cylindrical body and the clamping die increases and results in less surface pressure on the cylindrical body from the clamping die.

2. The system according to claim 1, wherein each of the flexible clamping die lips has a substantially gradually tapering thickness from a bottom to an opening of the first or second groove.

3. The system according to claim 1, wherein each of the first and second grooves is filled with a resilient material different from a material of parts of the clamping die surrounding the respective first or second groove.

4. The system according to claim 1, wherein each of the first and second grooves is filled with polyurethane.

5. The system according to claim 1, comprising a slips means including the clamping die.

6. The system according to claim 5, wherein the slips means is arranged in a spherical seat within a rotary table in a drill floor.

7. The system according to claim 6, wherein a spherical turning surface center of the spherical seat is arranged at or in close proximity to a rotary axis of the rotary table.

8. The system according to claim 5, wherein the slips means comprises a plurality of auxiliary wedges each being arranged for sliding support of the clamping die or at least one additional clamping die.

9. The system according to claim 8, wherein at least one of the plurality of auxiliary wedges is provided with an actuator which is arranged for displacement of the plurality of auxiliary wedges along an inclined plane.

10. The system according to claim 8, wherein each of the plurality of auxiliary wedges is connected to adjacent auxiliary wedges by means of one or two carriers for synchronous motion of the plurality of auxiliary wedges.

* * * * *